United States Patent [19]

Blair et al.

[11] 3,964,622

[45] June 22, 1976

[54] QUICK CHANGE MOUNTING BRACKET FOR LOADER ARMS

[75] Inventors: Calvin B. Blair, Barnard; Donald C. Hokr, Lincoln, both of Kans.

[73] Assignee: Kent Manufacturing Co., Inc., Tipton, Kans.

[22] Filed: Mar. 17, 1975

[21] Appl. No.: 558,831

[52] U.S. Cl. ..... 214/145 A; 37/117.5; 172/272

[51] Int. Cl.[2] ..... E02F 3/70

[58] Field of Search ..... 37/117.5; 172/272, 273, 172/274, 275; 214/131 A, 145; 248/200, 201, 220.5, 223, 224, 225; 292/30, 31, 119, 120, 153, 162, 175, 302, 335

[56] References Cited

UNITED STATES PATENTS

| | | | |
|---|---|---|---|
| 2,468,683 | 4/1949 | Michal | 292/302 X |
| 2,524,083 | 10/1950 | Ronning | 172/274 X |
| 2,963,183 | 12/1960 | Przybylski | 214/145 |
| 3,237,795 | 3/1966 | Kromer | 37/117.5 UX |
| 3,403,802 | 10/1968 | Lundell | 37/117.5 X |
| 3,512,665 | 5/1970 | Westendorf | 172/273 X |
| 3,583,589 | 6/1971 | Leijon | 37/117.5 X |
| 3,606,052 | 9/1971 | Schurz | 172/273 |
| 3,807,769 | 4/1974 | Thompson et al. | 172/272 X |
| 3,887,096 | 6/1975 | Wieland | 214/145 |

FOREIGN PATENTS OR APPLICATIONS

| | | | |
|---|---|---|---|
| 106,518 | 6/1965 | Norway | 214/145 |
| 225,304 | 8/1941 | Switzerland | 172/272 |
| 200,291 | 7/1923 | United Kingdom | 292/153 |
| 262,548 | 10/1970 | U.S.S.R. | 248/19 |

*Primary Examiner*—Roy D. Frazier
*Assistant Examiner*—Lawrence J. Staab
*Attorney, Agent, or Firm*—Fishburn, Gold & Litman

[57] ABSTRACT

A loading arm mounting bracket includes an upwardly open upper slot and a forwardly open lower slot respectively adapted to receive corresponding upper and lower pins of an implement bracket. A spring loaded lock plate is selectively received between the lower pin and slot-adjacent retaining plates, thereby removably securing the lower pin in the lower slot and trapping the upper pin in the upper slot. Manual release is obtained by pulling on a handle attached to the locking plate.

8 Claims, 5 Drawing Figures

QUICK CHANGE MOUNTING BRACKET FOR LOADER ARMS

This invention relates to remotely operated loader arms for tractors and, more particularly, to a quick change mounting bracket for mounting a loader implement or device to the free ends of the loader arms.

The principal objects of the present invention are: to provide a mounting bracket for loader arms which permits easy attachment to an implement or loading device without the necessity of aligning plate openings for the insertion of pins and the like; to provide such an arrangement which permits engagement between the loader arms and implement bracket through easy manipulations of the loader arms; to provide such an arrangement wherein the manual locking and unlocking of the brackets is unusually simple, safe and fool-proof; and to provide such a mounting system which is inexpensive in construction and yet very well suited for its intended purpose.

Other objects and advantages of this invention will become apparent from the following description taken in connection with the accompanying drawings wherein are set forth, by way of illustration and example, certain embodiments of this invention.

Figure 2:
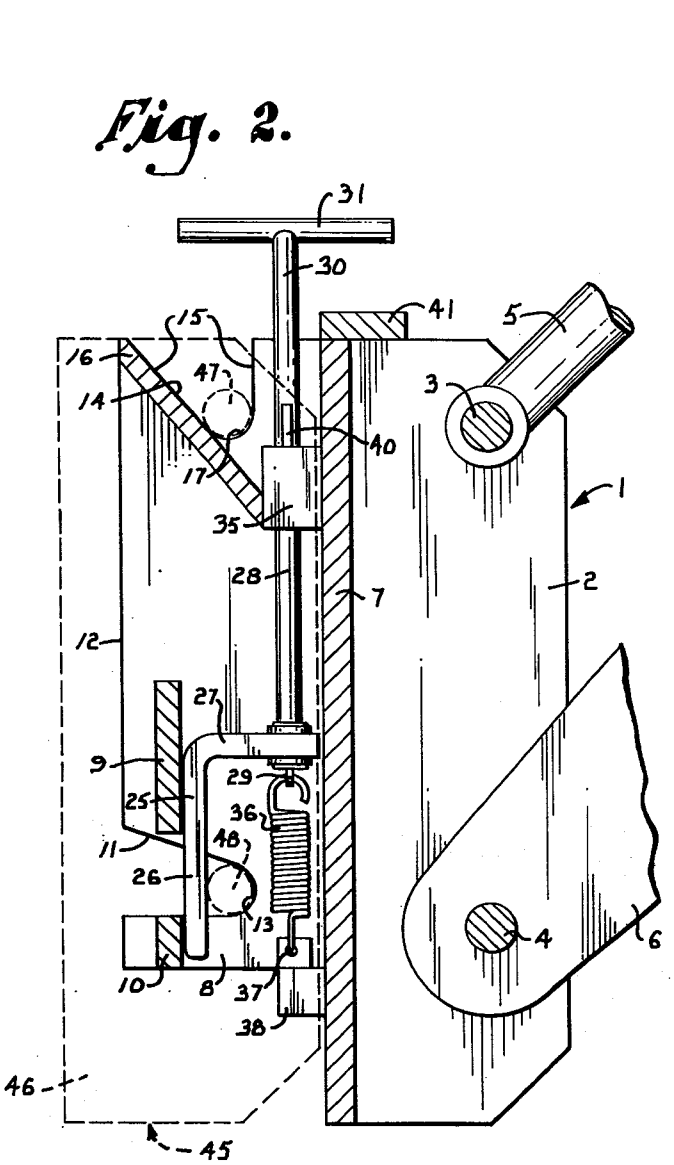
FIG. 2 is a view similar to FIG. 1 but showing the locking bracket in locked condition, the connecting implement bracket and pins being shown in broken lines.

Referring to the drawings in more detail:

The reference numeral 1 generally indicates a locking bracket embodying this invention. The bracket 1 includes conventional, laterally spaced, parallel, rear plates 2 supporting an upper pin 3 and a lower pin 4 which are engaged respectively by an upper loader arm 5 and lower loader arm 6. A transverse plate 7 maintains the rear plates 2 in fixed, relative relation and also supports a pair of laterally spaced front plates 8 welding thereto and projecting forwardly therefrom. Upper and lower blocks 9 and 10 are welded to and project between the front plates 8. The blocks 9 and 10 are spaced apart vertically and in alignment on opposite sides of transversely aligned lower slots 11 which project rearwardly into the front plates 8 from the respective front edge 12 thereof. The slots 11 taper inwardly, or toward each other, as they move rearwardly, terminating in a rounded rear seat 13 spaced substantially rearwardly of the blocks 9 and 10.

Upper aligned slots 14 are also formed in the front plates 8 and have opposed edges 15 which taper inwardly, or toward each other, at an angle greater than the corresponding edges of the lower aligned slots 11. In further contrast, the upper slots 14 open generally upwardly rather than the forwardly opening arrangement of the lower slots 11.

A transverse plate 16 is secured to, as by welding, and projects between the front plates 8 adjacent and along the forwardmost slot edge 15. The plate 16 provides a laterally extending continuation of the slot front edge, as well as rigid support for the upper portions of the front plates 8. The edges 15 of the slots 14 curve toward each other to form rounded rear seats 17 corresponding to the lower slot seats 13.

A locking plate 25 is positioned between the front plates 8 and, in this example, comprises a vertical portion 26 and a horizontal portion 27. The horizontal portion 27 is supported by a vertical shaft 28 which is rotatably engaged therewith at the shaft lower end 29. The shaft upper end 30 carries a handle 31 which is easily grasped by the hand of an operator standing adjacent thereto.

The shaft 28 is retained in a bearing block 35 with freedom for both rotation and longitudinal motion. The block 35 is secured to the transverse plates 7 and 16, preferably by welding. A helical spring is secured at opposite ends thereof respectively to the lower end 29 of the shaft 28 and an anchor 37 mounted, in this example, on a transverse bar 38 secured to the plates 7 and 8.

Figure 1:
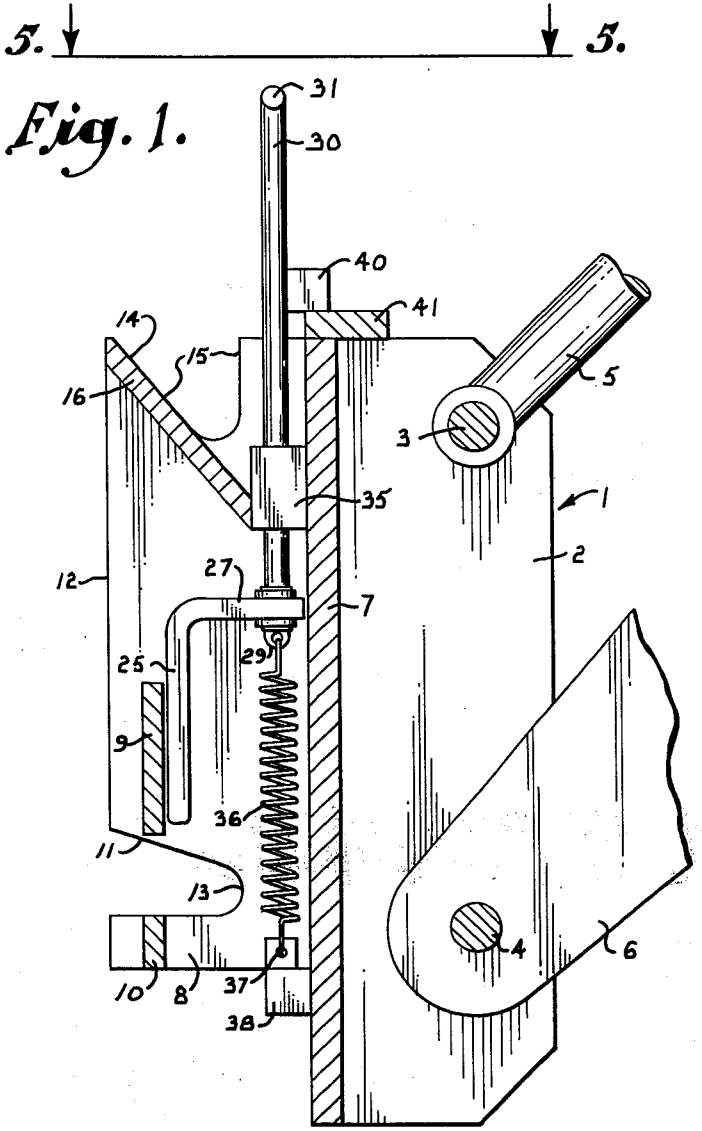
FIG. 1 is a fragmentary, cross-sectional, side elevational view of a locking bracket, with a wall removed, showing interior structure and in unlocked condition.
Figure 5:
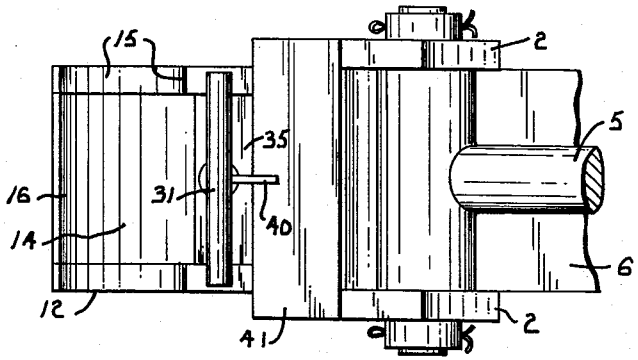
FIG. 5 is a plan view taken on the line 5—5, FIG. 1, further showing the relationship between various parts of the locking bracket.

A radially projecting key 40 on the shaft 28 selectively engages an upper transverse bar 41 which is secured to the rear bracket plates 2 and functions to support the shaft 28 and, thereby, the locking plate 25 in the upper or unlocked position shown in FIG. 1. When the shaft 28 is rotated, as by the handle 31, so that the key 40 is out of contact with the upper bar 41, the stretched spring 36 draws the shaft 28 downwardly, carrying with it the locking plate 25 to the position shown in FIG. 2, where the entrance to, and exit from, the rear seat 13 is blocked by the locking plate vertical portion 26.

The implement bracket 45 is comprised of parallel side plates 46 spaced laterally apart a distance sufficient to receive the spaced front plates 8 therebetween. Upper and lower pins 47 and 48 are rigidly secured to the side plates 46, extend in parallel relation therebetween and are spaced apart a distance substantially equal to the space between the slot rear seats 17 and 13.

Figure 3:
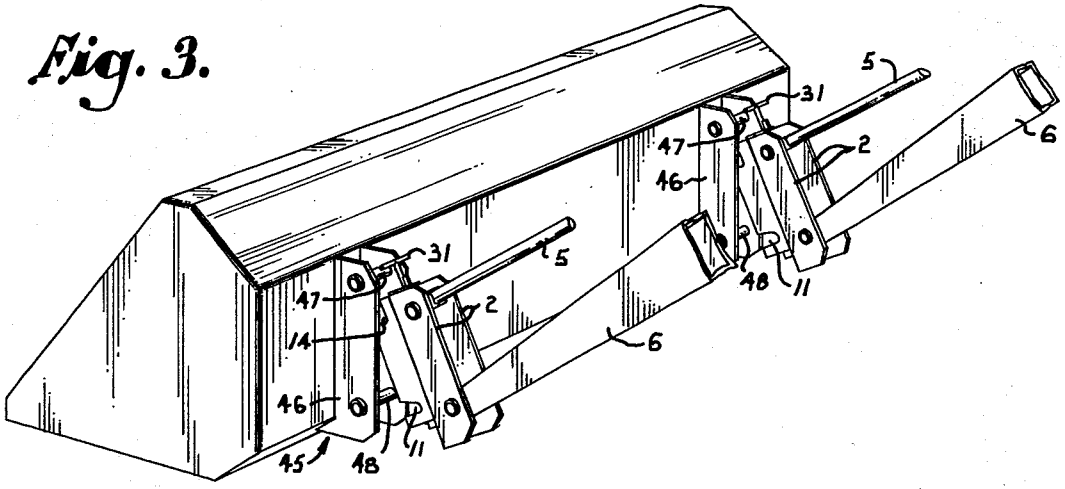
FIG. 3 is a fragmentary perspective view showing the locking bracket positioned near associated implement brackets for engagement.

When it is desired to engage the implement brackets with the loader arms, the locking brackets 1, with the keys 40 bearing upon the blocks 41, are manipulated, preferably from the tractor, to the position shown in FIG. 3, where the implement bracket upper pins 47 are receivable into the upper slots 14 and bottomed in the seats 17. The locking brackets are then manipulated so that they rotate generally about the upper pin 47, thereby directing the aligned slots 11 over or about the lower pins 48 and against the rear seats 13. The handles 31 are then rotated, for example, a quarter turn, thereby disengaging the key 40 from the block 41, whereupon the spring 36 functions to pull the shaft 28 and locking plate portion 26 downwardly to the position shown in FIG. 2, where the lower pins 48 are trapped in the rear seats 13.

With the lower pins 48 trapped in the rear seats 13, the upper pins 47 cannot leave the upper seats 17 since there is a fixed distance between the upper and lower pins. In utilizing the implement, in this example bucket 49, forces of considerable magnitude may be safely applied in any direction with assurance against accidental disengagement. Forces tending to drive the pins 48 forwardly out of the aligned slots 11 will be effectively resisted by the spaced blocks 9 and 10 preventing forward movement of the locking plate vertical portion 26.

Figure 4:
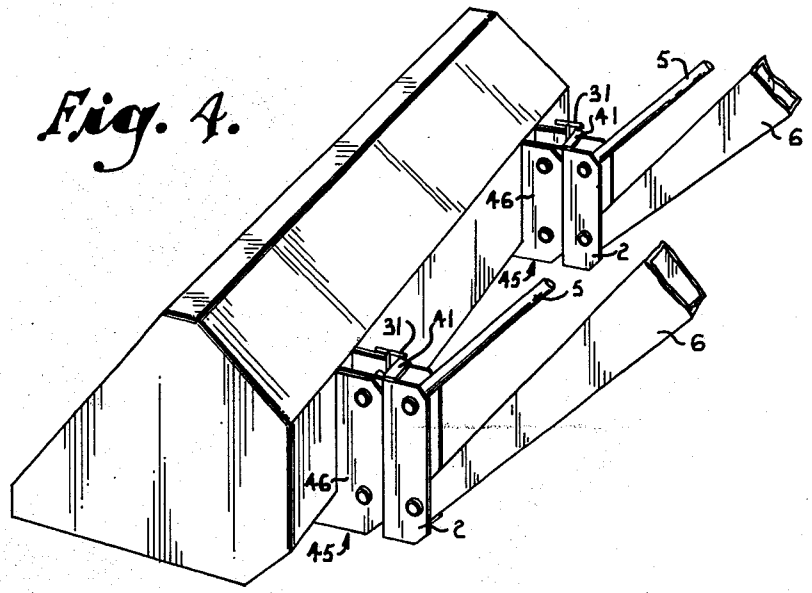
FIG. 4 is a perspective view, similar to FIG. 3, but showing the locking brackets and implement brackets engaged and locked together for operation.

When it is desired to remove the locking brackets 1 from the implement brackets 45, the structure is rested upon the ground, as in FIG. 4, so that the pins 48 are not pressed firmly against the plate vertical portions 26 and the handles 31 are lifted and turned so that the keys 40 again rest upon the upper bars 41. The brackets 1 may then be simply rotated rearwardly about the upper pins 47 so that the lower pins 48 are directed out of the aligned slots 11. The brackets 1 are then manipulated rearwardly whereupon the upper pins 47 exit from the upper slots 14, completing the disengagement.

It is to be understood that while certain forms of this invention have been illustrated and described, it is not to be limited thereto except insofar such limitations are included in the following claims.

What is claimed and desired to secure by Letters Patent is:

1. A locking bracket for loader arms and adapted to engage an implement bracket having upper and lower, spaced apart, transverse pins, said locking bracket comprising:

a. a pair of laterally spaced, forwardly projecting plates together having a pair of aligned upper slots and a pair of aligned lower slots therein, said upper and lower slots each having a seat for receiving said respective transverse pins, b. said upper slot opening generally upwardly of said forwardly projecting plates and said lower slots opening generally forwardly of said forwardly projecting plates, c. at least one block located near said lower slot and spaced forwardly of said lower slot seats, a locking member including a shaft spaced rearwardly of said upper slot seats and a locking plate mounted on said shaft and having a locking portion spaced forwardly of said lower seats and rearwardly of said block, said shaft being adapted for selectively moving said locking portion to a slot blocked position between said block and one of said lower pins with said lower pins in said lower slot seats, and d. means for securing said forwardly projecting plates to said loader arms, e. whereby said upper and lower pins are selectively locked in said forwardly projecting plates when received in said seats.

2. The structure as set forth in claim 1 including:

a. a spring operably connected to said locking member and urging same toward said slot blocked position.

3. The structure as set forth in claim 1 including:

a. a spring mounted between said forwardly projecting plates and urging said shaft and locking portion toward said slot blocked position.

4. The structure as set foth in claim 1 including:

a. a key secured to said shaft and adapted to selectively support said locking member in unlocked position.

5. The structure as set forth in claim 1 including:

a. a handle on said shaft for manually moving said locking portion.

6. The structure as set forth in claim 1 including:

a. a bearing secured between said forwardly projecting plates and receiving said shaft longitudinally and rotatably movable therein.

7. The structure as set forth in claim 4 wherein:

a. said locking plate is rotatably mounted on said shaft permitting the relative rotation between said locking plate and said key.

8. A locking bracket for loader arms and adapted to engage an implement bracket having upper and lower spaced apart transverse pins, said lock comprising:

a. at least one forwardly projecting plate having an upper slot and a lower slot therein, said upper and lower slots each having a seat for receiving said respective pins, b. at least one block located near one of said slots and spaced forwardly of said one slot seat, a locking member including a shaft spaced rearwardly of said other slot seat and a locking plate mounted on said shaft and having a locking portion spaced forwardly of said one slot seat and rearwardly of said block, said shaft being adapted for selectively moving said locking portion to a slot blocking position between said block and one of said pins with said last named pin in said one slot seat, and c. means for securing said plate to said loader arms.

* * * * *